US007066283B2

(12) United States Patent
Livingstone

(10) Patent No.: US 7,066,283 B2
(45) Date of Patent: Jun. 27, 2006

(54) REVERSE CIRCULATION DIRECTIONAL AND HORIZONTAL DRILLING USING CONCENTRIC COIL TUBING

(75) Inventor: James I. Livingstone, Calgary (CA)

(73) Assignee: PresssoL Ltd., Calgary (CA)

( * ) Notice: Subject to any disclaimer, the term of this patent is extended or adjusted under 35 U.S.C. 154(b) by 0 days.

(21) Appl. No.: 10/644,749

(22) Filed: Aug. 21, 2003

(65) Prior Publication Data

US 2004/0104052 A1 Jun. 3, 2004

Related U.S. Application Data

(60) Provisional application No. 60/404,787, filed on Aug. 21, 2002.

(51) Int. Cl.
*E21B 7/04* (2006.01)
*E21B 17/20* (2006.01)

(52) U.S. Cl. ..... 175/61; 175/62; 175/215

(58) Field of Classification Search ..... 166/45, 166/61, 73, 74, 231, 320; 175/45, 61, 62, 175/73, 74, 215, 231, 320, 48, 92, 296
See application file for complete search history.

(56) References Cited

U.S. PATENT DOCUMENTS

| | | | | |
|---|---|---|---|---|
| 2,609,836 A | | 9/1952 | Knox | |
| 2,707,616 A | * | 5/1955 | Schad et al. | 175/231 |
| 3,075,589 A | | 1/1963 | Grable et al. | |
| 3,416,618 A | | 12/1968 | Kunnemann | |
| 3,770,006 A | | 11/1973 | Sexton et al. | |
| 3,792,429 A | | 2/1974 | Patton et al. | |
| 3,795,283 A | | 3/1974 | Oughton | |
| 3,920,090 A | | 11/1975 | McQueen et al. | |
| 4,055,224 A | | 10/1977 | Wallers | |
| 4,100,528 A | | 7/1978 | Bernard et al. | |
| 4,219,087 A | | 8/1980 | Johnson | |
| 4,243,252 A | | 1/1981 | Johnson | |
| 4,321,974 A | | 3/1982 | Klemm | |
| 4,391,328 A | | 7/1983 | Aumann | |
| 4,431,069 A | | 2/1984 | Dickinson, III et al. | |
| 4,461,448 A | | 7/1984 | Huey et al. | |
| 4,463,814 A | | 8/1984 | Horstmeyer et al. | |

(Continued)

FOREIGN PATENT DOCUMENTS

CA 1325969 10/1987

(Continued)

OTHER PUBLICATIONS

Underbalanced Drilling; Nowsco.

(Continued)

*Primary Examiner*—Kenneth Thompson
(74) *Attorney, Agent, or Firm*—Bennett Jones LLP

(57) ABSTRACT

Method and apparatus for drilling a directional or horizontal wellbore in a hydrocarbon formation using concentric coiled tubing drill string having an inner coiled tubing string and an outer coiled tubing string defining an annulus there between. A bottomhole assembly comprising a directional drilling means is provided at the lower end of the concentric coiled tubing drill string for reverse circulation drilling. Directional drilling means comprises a reciprocating air hammer and a drill bit, a positive displacement motor and a reverse circulating drill bit, or a reverse circulating mud motor and a rotary drill bit, and a bent sub or housing. Drilling medium is delivered through the annulus or inner coiled tubing string for operating the directional drilling means to form the directional or horizontal wellbore. Exhaust drilling medium comprising drilling medium, drilling cuttings and hydrocarbons are removed from the wellbore by extraction through the other of the annulus or inner coiled tubing string.

60 Claims, 8 Drawing Sheets

U.S. PATENT DOCUMENTS 4,509,606 A 4/1985 Willis
4,534,426 A 8/1985 Hooper
4,647,002 A 3/1987 Crutchfield
4,671,359 A 6/1987 Renfro
4,681,164 A 7/1987 Stacks
4,705,119 A 11/1987 Kostylev et al.
4,709,768 A 12/1987 Kostylev et al.
4,718,503 A 1/1988 Stewart
4,739,844 A 4/1988 Farris et al.
4,744,420 A 5/1988 Patterson et al.
4,790,391 A 12/1988 Hamamura et al.
4,832,126 A 5/1989 Roche
4,834,193 A * 5/1989 Leitko et al. ..... 175/19
5,006,046 A 4/1991 Buckman et al.
5,020,611 A 6/1991 Morgan et al.
5,033,545 A 7/1991 Sudol
5,068,842 A 11/1991 Naito
5,117,927 A * 6/1992 Askew ..... 175/61
5,174,394 A 12/1992 Fischer et al.
5,178,223 A 1/1993 Smet
5,199,515 A 4/1993 Sinclair et al.
5,236,036 A 8/1993 Ungemach et al.
5,285,204 A 2/1994 Sas-Jaworsky
5,348,097 A 9/1994 Giannesini et al.
5,396,966 A 3/1995 Roos, Jr. et al.
5,411,105 A 5/1995 Gray
5,435,395 A 7/1995 Connell
5,513,528 A 5/1996 Holenka et al.
5,575,451 A 11/1996 Colvin et al.
5,638,904 A 6/1997 Misselbrook et al.
5,720,356 A 2/1998 Gardes
5,881,813 A 3/1999 Brannon et al.
5,890,540 A 4/1999 Pia et al.
5,892,460 A 4/1999 Jerabek et al.
6,015,015 A 1/2000 Luft et al.
6,047,784 A 4/2000 Dorel
6,065,550 A 5/2000 Gardes
6,109,370 A 8/2000 Gray
6,158,531 A 12/2000 Vail, III
6,189,617 B1 2/2001 Sorhus et al.
6,192,985 B1 2/2001 Hinkel et al.
6,196,336 B1 3/2001 Fincher et al.
6,209,663 B1 4/2001 Hosie
6,209,665 B1 4/2001 Holte
6,213,201 B1 4/2001 Renkis
6,250,383 B1 6/2001 Patel
6,263,987 B1 7/2001 Vail, III
6,325,159 B1 12/2001 Peterman et al.
6,359,438 B1 3/2002 Bittar
6,377,050 B1 4/2002 Chemali et al.
6,394,197 B1 5/2002 Holte
6,405,809 B1 6/2002 Patel et al.
6,457,540 B1 10/2002 Gardes
6,481,501 B1 11/2002 Chavez et al.
6,668,933 B1 12/2003 Kent
6,745,855 B1 6/2004 Gardes
6,854,534 B1 * 2/2005 Livingstone ..... 175/57
2002/0000332 A1 1/2002 Merecka et al.
2003/0141111 A1 7/2003 Pia
2003/0150621 A1 8/2003 Pia

FOREIGN PATENT DOCUMENTS

EP 0787886 5/1997
EP 1 245 783 2/2002
FR 2597150 4/1986
GB 2368079 10/2000
WO WO 97/05361 2/1997
WO WO 97/35093 9/1997
WO WO 00/57019 9/2000
WO WO 01/90528 11/2001
WO WO 02/10549 2/2002

OTHER PUBLICATIONS

Nowsco/Downhole Systems: "Test, Treat, Test System Using a Concentric Coiled Tubing/DST Package":Hoyer, Fried & Sask.

BlackMax Downhole Tools; An NQL Drilling Tools Inc. Company; Electro Magnetic Measurement While Drilling; Oil & Gas Application; EM=MWD.

Logging While Drilling; http://www.odp.tamu.edu/publications/196_IR/chap_2/c2_.htm.

Drilling and Formation Evaluation; Baker Hughes; www.bakerhughes.com/bakerhughes/products/well.htm.

On Trak MWD System; Baker Hughes; www.bakerhughes.com/inteq/evaluation/ontrak/index.htm.

PressTEQ Application Examples; Baker Hughes; www.bakerhughes.com/inteq/D&P/pressure/index.htm.

Thruster Drilling System; Baker Hughes; www.bakerhughes.com/inteq/Drilling/thruster/index.htm.

Coiled Tubing; Baker Hughes; Baker Oil Tools Coiled Tubing Solutions; www.bakerhughes.com/bot/coiled_tubing/index/htm.

COLT Coil Tubing Drilling Bottom Hole Assembly; Antech Special Engineering Products; Coiled Tubing Downhole Tools.

U.S. Appl. No. 10/644,749, filed Aug. 21, 2003, by Livingstone.

* cited by examiner

REVERSE CIRCULATION DIRECTIONAL AND HORIZONTAL DRILLING USING CONCENTRIC COIL TUBING

This application claims the benefit of U.S. Provisional Application No. 60/404,787, filed on Aug. 21, 2002.

FIELD OF THE INVENTION

The present invention relates generally to a drilling method and apparatus for exploration and production of oil, natural gas, coal bed methane, methane hydrates, and the like. More particularly, the present invention relates to a concentric coiled tubing drill string drilling method and apparatus useful for reverse circulation drilling of directional and horizontal wellbores.

BACKGROUND OF THE INVENTION

Drilling for natural gas, oil, or coalbed methane is conducted in a number of different ways. In conventional overbalanced drilling, a weighted mud system is pumped through a length of jointed rotating pipe, or, in the case of coiled tubing, through a length of continuous coiled tubing, and positive displacement mud motor is used to drive a drill bit to drill a borehole. The drill cuttings and exhausted pumped fluids are returned up the annulus between the drill pipe or coiled tubing and the walls of the drilled formation. Damage to the Formations, which can prohibit their ability to produce oil, natural gas, or coalbed methane, can occur by filtration of the weighted mud system into the formation due to the hydrostatic head of the fluid column exceeding the pressure of the formations being drilled. Damage may also occur from the continued contact of the drilled formation with drill cuttings that are returning to surface with the pumped fluid.

Underbalanced drilling systems have been developed which use a mud or fluid system that is not weighted and under pumping conditions exhibit a hydrostatic head less than the formations being drilled. This is most often accomplished by pumping a commingled stream of liquid and gas as the drilling fluid. This allows the formations to flow into the wellbore while drilling, thereby reducing the damage to the formation. Nevertheless, some damage may still occur due to the continued contact between the drill cuttings and exhausted pumped fluid that are returning to surface through the annulus between the drill string or coiled tubing and the formation.

Air drilling using an air hammer or rotary drill bit can also cause formation damage when the air pressure used to operate the reciprocating air hammer or rotary drill bit exceeds formation pressure. As drill cuttings are returned to surface on the outside of the drill string using the exhausted air pressure, damage to the formation can also occur.

Formation damage is becoming a serious problem for exploration and production of unconventional petroleum resources. For example, conventional natural gas resources are deposits with relatively high formation pressures. Unconventional natural gas formations such as gas in low permeability or "light" reservoirs, coal bed methane, and shale gases have much lower pressures. Therefore, such formations would damage much easier when using conventional oil and gas drilling technology.

Directional and horizontal drilling technology using a single coiled tubing drill string is known in the art. Thus, downhole tools useful for directional and horizontal drilling using coiled tubing are readily available. For example, coiled tubing drilling operations use existing technologies for directional measurement systems and orientation of the drilling assembly, but because such devices are being used with single strings of coiled tubing, drilling fluids are pumped down the coiled tubing and returned up the annulus between the coiled tubing and the wellbore wall.

In Canadian Patent # 2,079,071 and U.S. Pat. No. 5,215,151, issued to Smith and Goodman, incorporated herein by reference, a directionally drilling method is taught using coiled tubing which involves connection of a directional bottom hole assembly to a single string of coiled tubing. The directional bottom hole assembly is in electrical communication with existing directional drilling downhole sensors by means of an electric cable inside the coiled tubing. The downhole sensors are coupled with a device for orienting or rotating the bottom hole assembly by way of fluid pressure or fluid rate variations. This drilling technology can be used in underbalanced drilling operations.

U.S. Pat. No. 5,394,951, issued to Pringle et al, incorporated herein by reference, teaches a method of directional drilling with coiled tubing using a commercially available electrical steering tool, mud-pulse and/or electromagnetic measurement-while-drilling (MWD) equipment. Further, Canadian Patent No. 2,282,342, issued to Ravensbergen et al, incorporated herein by reference, defines a bottom hole assembly for directional drilling with coiled tubing which includes electrically operated downhole data sensors and an electrically operated orientor for steering capabilities while drilling.

Common to all the above referenced patents is the use of a single string of coiled tubing with a single path of flow within the coiled tubing. These patents further establish the existence of directional drilling capabilities on coiled tubing, with some reference to underbalanced drilling operations. The present invention extends the application of these existing technologies to concentric coiled tubing operations with reverse circulation of drill cuttings and formation fluids so as to avoid prolonged contact of these materials and associated damage with the formation. The present invention uses existing coiled tubing directional drilling technologies modified to provide for reverse circulation of the drilling medium and produced fluids.

The present invention reduces the amount of contact between the formation and drill cuttings which normally results when using air drilling, mud drilling, fluid drilling and underbalanced drilling by using a concentric coiled tubing string drilling system. Such a reduction in contact will result in a reduction in formation damage.

SUMMARY OF THE INVENTION

The present invention allows for the directional and horizontal drilling of hydrocarbon formations in a less damaging and safe manner. The invention works particularly well in under-pressured hydrocarbon formations where existing underbalanced technologies can damage the formation.

Directional and horizontal drilling technology for coiled tubing exist today and are common operations. These operations use existing technologies for directional measurement systems and orientation of the drilling assembly, but are conduct d on single strings of coiled tubing such that fluids are pumped down the coiled tubing and returned up the annulus between the coiled tubing and the wellbore wall. The present invention uses a two-string or concentric coiled tubing drill string allowing for drilling fluid and drill cuttings to be removed through the concentric coiled tubing drill string, instead of through the annulus between the drill string and the formation. The present invention uses existing coiled tubing directional drilling tools modified to provide for reverse circulation of the drilling medium and produced fluids. For example, an outer casing can be provided for encasing existing directional drilling tools such that an annulus is formed between the outer wall of the tool and the inside wall of the outer casing.

The use of coiled tubing instead of drill pipe provides the additional advantage of continuous circulation while drilling, thereby minimizing pressure fluctuations and reducing formation damage. When jointed rotary pipe is used, circulation must be stopped while making or breaking connections to trip in or out of the hole. Further, when using jointed pipe, at each connection, any gas phase in the drilling fluid tends to separate out of the fluid resulting in pressure fluctuations against the formation.

The present invention allows for a wellbore to be drilled directionally or horizontally, either from surface or from an existing casing set in the ground at some depth, using reverse circulation so as to avoid or minimize contact between drill cuttings and the formation that has been drilled. Thus, the present invention can be used to drill the entire wellbore or just a portion of the wellbore, as required. The wellbore may be drilled overbalanced or underbalanced with drilling medium comprising drilling mud, drilling fluid, gaseous drilling fluid such as compressed air or a combination of drilling fluid and gas. In any of these cases, the drilling medium is reverse circulated up the concentric coiled tubing drill string with the drill cuttings such that drill cuttings are not in contact with the formation. Where required for safety purposes, an apparatus is included in or on the concentric coiled tubing string which is capable of dosing off flow from the inner string, the annulus between the outer string and the inner string, or both to safeguard against uncontrolled flow from the formation to surface.

The present invention has a number of advantages over conventional drilling technologies in addition to reducing drilling damage to the formation. The invention reduces the accumulation of drill cuttings in the deviated or horizontal section of the wellbore; it allows for gas zones to be easily identified; and multi-zones of gas in shallow gas wellbores can easily be identified without significant damage during drilling.

The present invention is also useful for well stimulation. Hydraulic fracturing has been one of the most common methods of well stimulation in the oil and gas industry. This method of stimulation is not as effective in low and under pressure reservoirs. Five types of reservoir damage can occur in low and under pressure reservoirs when hydraulic fracturing is used, namely:

1. the pore throats in the rock plug up due to the movement of secondary days;
2. fracturing gel, fracturing sand and fracturing acid compounds remain in the reservoir;
3. swelling of smectitic clays;
4. chemical additives cause precipitation of minerals and compounds in the reservoir; and
5. improper clean out of wellbore to remove materials from deviated section of the wellbore can cause serious damage to producing reservoirs.

Accessing natural fractures is one of the most important parts of completing any well in the oil and gas industry, and this is critical to the success of a low or under pressure well. Studies conducted by the United States Department of Energy showed that in a blanket gas reservoir on average a vertical drilled well encounters one Fracture, a deviated drilled well encounters fifty-two fractures and a horizontally drilled well thirty-seven fractures.

Use of the reverse circulation drilling method and apparatus for forming directional and horizontal wells provides the necessary stimulaflon of the well without the damage caused by hydraulic fracturing.

Thus, the present invention allows low and under pressure formations or reservoirs to receive the necessary well stimulation with ut damage that is usually encountered using hydraulic fracturing.

In accordance with one aspect of the invention, a method for drilling a directional or horizontal wellbore in a hydrocarbon formation is provided herein, comprising the steps of:

providing a concentric coiled tubing drill string having an inner coiled tubing string, said inner coiled tubing string having an inside wall and an outside wall and situated within an outer coiled tubing string having an inside wall and an outside wall, said outside wall of said inner coiled tubing string and said inside wall of said outer coiled tubing string defining an annulus between the coiled tubing strings;

connecting a bottomhole assembly comprising a directional drilling means, said directional drilling means having a drill bit and a downhole motor or an air hammer for operating the drill bit, to the coiled tubing drill string so that the bottomhole assembly is in fluid communication with the coiled tubing drill sting;

delivering drilling medium through one of said annulus or inner coiled tubing string to said downhole motor or air hammer for operating the drill bit to form said directional or horizontal wellbore; and extracting exhaust drilling medium through said other of said annulus or inner coiled tubing string.

The coiled tubing strings may be constructed of steel, fiberglass, composite material, or other such material capable of withstanding the forces and pressures of the operation. The coiled tubing strings may be of consistent wall thickness or tapered.

In one embodiment of the drilling method, the exhaust drilling medium is delivered through the annulus and removed through the inner coiled tubing string. The exhaust drilling medium comprises any combination of drill cuttings, drilling medium and hydrocarbons.

In another embodiment, the flow paths may be reversed, such that the drilling medium is pumped down the inner coiled tubing string to drive the directional drilling means and exhaust drilling medium, comprising any combination of drilling medium, drill cuttings and hydrocarbons, is extracted through the annulus between the inner coiled tubing string and the outer coiled tubing string.

The drilling medium can comprise a liquid drilling fluid such as, but not limited to, water, diesel, or drilling mud, or a combination of liquid drilling fluid and gas such as, but not limited to, air, nitrogen, carbon dioxide, and methane, or gas alone. The drilling medium is pumped down the annulus to the directional drilling means to drive the directional drilling means.

Examples of suitable directional drilling means comprise a reverse-circulating mud motor with a rotary drill bit, or a mud motor with a reverse circulating drilling bit. When the drilling medium is a gas, a reverse circulating air hammer or a positive displacement air motor with a reverse circulating drill bit can be used. The directional drilling means further comprises a bent sub or bent housing which provides a degree of misalignment of the lower end of the directional drilling means relative to the upper end of the directional drilling means. This degree of misalignment results in the drilling of new formation in a direction other than straight ahead.

As stated above, existing drilling tools for single wall coiled tubing can be modified by encasing them in an outer casing such that an annulus is formed between the outer wall of the tool and the inside wall of the outer casing. In the alternative, existing drilling tools for single wall coiled tubing can be used with an interchange means located at or near the top of the bottomhole assembly. For example. U.S. Pat. No. 5,394,951, which was previously incorporated by reference, discloses a downhole mud motor to rotate a drill bit. Thus, directional drilling means can comprise a mud motor and a drill bit. Further, U.S. Pat. No. 5,215,151, discloses a downhole motor such as a positive displacement hydraulic motor, which can be operated by the water or other hydraulic fluid, to rotate a drill bit. Thus, directional drilling means can comprise a positive displacement motor and a drill bit.

U.S. Pat. No. 5,394,951 describes the operation of a downhole motor to rotate a drill bit as follows. Mud pumps at the earth's surface force drilling fluids downwardly within the coiled tubing to the motor. The motor is operated by drilling fluids moving axially over an internal rotor/stator assembly and converting hydraulic energy into mechanical energy resulting in bit rotation with high torque.

In a preferred embodiment, the directional drilling means further comprises a diverter means such as, but not limited to, a venturi or a fluid pumping means, which diverts or draws the exhaust drilling medium, the drill cuttings, and any hydrocarbons back into the inner coiled tubing string where they are flowed to surface. This diverter means may be an integral part of the directional drilling means or a separate apparatus.

In a preferred embodiment, the bottomhole assembly further comprises an orientation means such as, but not limited to, an electrically or hydraulically operated rotation device capable of rotating the directional drilling means so as to orientate the direction of the wellbore to be dilled.

The orientation means can operate in a number of different ways, including, but not limited to:

1. providing an electrical cable which runs inside the inner coiled tubing string from surface to the end of the concentric string, such that the orienting means is in electrical communication with a surface control means;
2. providing a plurality of small diameter capillary tubes which run inside the inner coiled tubing string from surface to the end of the concentric string, such that the orienting means is in hydraulic communication with a surface control means In a preferred embodiment, the bottomhole assembly further comprises a downhole data collection and transmission means such as, but not limited to, a measurement while drilling tool or a logging while drilling tool, or both. Such tools provide a number of parameters, including, but not limited to, azimuth, inclination, magnetics, vibration, pressure, orientation, gamma radiation, and fluid resistivity.

The downhole data collection and transmission means can operate in a number of different ways, including, but not limited to:

1. providing an electrical cable which runs inside the inner coiled tubing string from surface to the end of the concentric string, such that the downhole data collection and transmission means is in electrical communication with a surface data collection and transmission means;
2. providing a plurality of small diameter capillary tubes which run inside the inner coiled tubing string from surface to the end of the concentric string, such that the downhole data collection and transmission means is in hydraulic communication with a surface data collection and transmission means;
3. providing a plurality of fiber optic cables which run inside the inner coiled tubing string from surface to the end of the concentric string, such that the downhole data collection and transmission means is in communication with a surface data collection and transmission means by way of light pulses or signals; and
4. providing a radio frequency or electromagnetic transmitting device located at within the downhole data collection and transmission means which communicates to a receiving device situated in a surface data collection and transmission means.

When used in conjunction with the orienting means and the downhole data and transmission means, the directional drilling means allows for the steering of the well trajectory in a planned or controlled direction.

The method for drilling a directional or horizontal wellbore can further comprise the step of providing a downhole flow control means attached to the concentric coiled tubing drill string near the directional drilling means for preventing any flow of hydrocarbons to the surface from the inner coiled tubing string or the annulus or both when the need arises. The downhole flow control means is capable of shutting off flow from the wellbore through the inside of the inner coiled tubing string, through the annulus between the inner coiled tubing string and the outer coiled tubing string, or through both.

The downhole flow control means can operate in a number of different ways, including, but not limited to:

1. providing an electrical cable which runs inside the inner coiled tubing string from surface to the end of the concentric string, such that the downhole now control means is activated by a surface control means which transmits an electrical charge or signal to an actuator at or near the downhole flow control means;
2. providing a plurality of small diameter capillary tubes which run inside the inner coiled tubing string from surface to the end of the concentric string, such that the downhole flow control means is activated by a surface control means which transmits hydraulic or pneumatic pressure to an actuator at or near the downhole flow control means;
3. providing a plurality of fiber optic cables which run inside the inner coiled tubing string from surface to the end of the concentric string, such that the downhole flow control means is activated by a surface control means which transmits light pulses or signals to an actuator at or near the downhole flow control means; and
4. providing a radio frequency transmitting device located at surface that actuates a radio frequency receiving actuator located at or near the downhole flow control means.

In another preferred embodiment, the method for drilling a directional or horizontal wellbore can further comprise the step of providing a surface flow control means for preventing any flow of hydrocarbons from the space between the outside wall of the outer coiled tubing string and the walls of the formation or wellbore. The surface flow control means may be in the form of annular bag blowout preventors, which seal around the outer coiled tubing string when operated under hydraulic pressure, or annular ram or closing devices, which seal around the outer coiled tubing string when operated under hydraulic pressure, or a shearing and sealing ram which cuts through both strings of coiled tubing and closes the wellbore pernanently. The specific design and configuration of these surface flow control means will be dependent on the pressure and content of the wellbore fluid, as determined by local law and regulation.

In another preferred embodiment, the method for drilling a directional or horizontal wellbore further comprises the step of reducing the surface pressure against which the inner coiled tubing string is required to flow by means of a surface pressure reducing means attached to the inner coiled tubing string. The surface pressure reducing means provides some assistance to the flow and may include, but not be limited to, a suction compressor capable of handling drilling mud, drilling fluids, drill cuttings and hydrocarbons installed on the inner coiled tubing string at surface.

In another preferred embodiment, the method for drilling a directional or horizontal wellbore further comprises the step of directing the extracted exhaust drilling medium to a discharge location sufficiently remote from the wellbore to provide for well site safety. This can be accomplished by means of a series of pipes, valves and rotating pressure joint combinations so as to provide for safety from combustion of any produced hydrocarbons. Any hydrocarbons present in the exhaust drilling medium can flow through a system of piping or conduit directly to atmosphere, or through a system of piping and/or valves to a pressure vessel, which directs flow from the well to a flare stack or riser or flare pit.

The present invention further provides an apparatus for drilling a directional or horizontal welibore in hydrocarbon formations, comprising:

- a concentric coiled tubing drill string having an inner coiled tubing string having an inside wall and an outside wall and an outer coiled tubing string having an inside wall and an outside wall, said outside wall of said inner coiled tubing string and said inside wall of said outer coiled tubing string defining an annulus between the coiled tubing strings;
- a bottomhole assembly comprising a directional drilling means, said directional drilling means having a drill bit and a downhole motor or an air hammer for operating the drill bit, operably connected to said concentric coiled tubing drill string; and
- a drilling medium delivery means for delivering drilling medium through one of said annulus or inner coiled tubing string for operating the directional drilling means to form said directional or horizontal wellbore and for entraining and removing drill cuttings through said other of said annulus or inner coiled tubing string.

The drilling medium can be air, drilling mud, drilling fluids, gases or various combinations of each.

In a preferred embodiment, the apparatus further comprises a downhole flow control means positioned near the directional drilling means for preventing flow of hydrocarbons from the inner coiled tubing string or the annulus or both to the surface of the wellbore.

In a further preferred embodiment, the apparatus further comprises a surface flow control means for preventing any flow of hydrocarbons from the space between the outside wall of the outer coiled tubing string and the walls of the wellbore.

In another preferred embodiment, the apparatus further comprises means for connecting the outer coiled tubing string and the inner coiled tubing string to the bottomhole assembly. The connecting means centers the inner coiled tubing string within the outer coiled tubing string, while still providing for isolation of flow paths between the two coiled tubing strings. In normal operation the connecting means would not allow for any movement of one coiled tubing string relative to the other, however may provide for axial movement or rotational movement of the inner coiled tubing string relative to the outer coiled tubing string in certain applications. The connecting means also provides for the passage of capillary tubes or capillary tube pressures, electric cable or electrical signals, fibre optics or fibre optic signals, or other such communication methods for the operation of a downhole data collection and transmission means and the orientation means, plus other devices as may be necessary or advantageous for the operation of the apparatus.

In another preferred embodiment, the apparatus further comprises a disconnecting means located between the connecting means and the directional drilling means, to provide for a way of disconnecting the directional drilling means from the concentric coiled tubing drill string. The means of operation can indude, but not be limited to, electric, hydraulic, or shearing tensile actions.

In another preferred embodiment, the apparatus further comprises a rotation means attached to the directional drilling means when said directional drilling means comprising an reciprocating air hammer and a drilling bit. This is seen as a way of improving the cutting action of the drilling bit.

In a preferred embodiment, the bottomhole assembly further comprises one or more tools selected from the group consisting of a downhole data collection and transmission means, a shock sub, a drill collar, a downhole flow control means and a interchange means.

In a preferred embodiment, the downhole data collection and transmission means comprises a measurement-while-drilling tool or a logging-while-drilling tool or both.

In another preferred embodiment, the apparatus further comprises means for storing the concentric coiled tubing drill string such as a work reel. The storage means may be integral to the coiled tubing drilling apparatus or remote, said storage means being fitted with separate rotating joints dedicated to each of the inner coiled tubing string and annulus. These dedicated rotating joints allow for segregation of flow between the inner coiled tubing string and the annulus, while allowing rotation of the coiled tubing work reel and movement of the concentric coiled tubing string in and out of the wellbore. The said storage means is also fitted with pressure control devices or bulkheads which allow the insertion of electric cable, capillary tubes, fibre optic cables, and other such communication means into the inner or outer coiled tubing strings while under pressure but allowing access to such communicating means at surface for surface operation of the downhole devices.

DESCRIPTION OF THE PREFERRED EMBODIMENTS

Figure 1A:
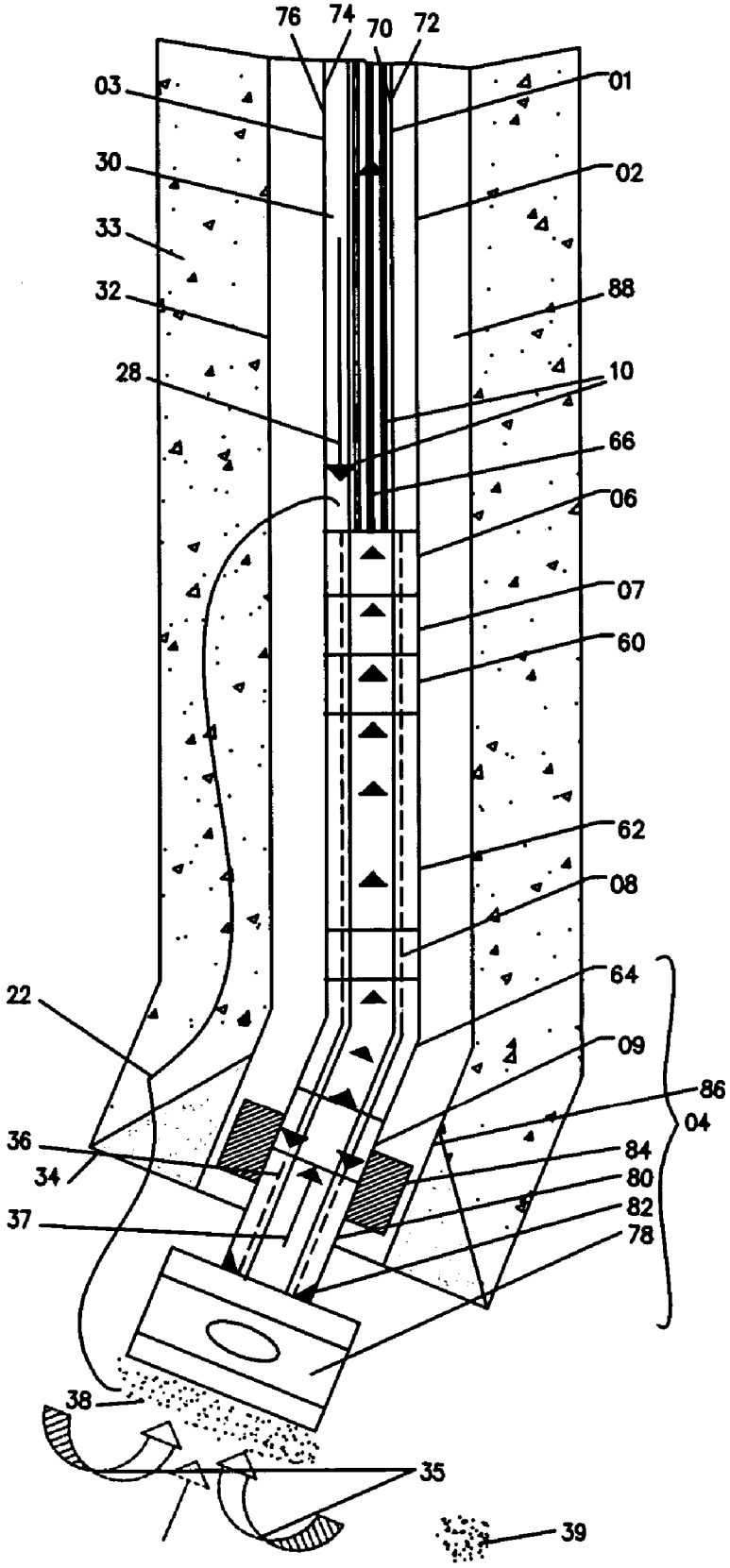
FIG. 1*a* is a vertical cross-section of a section of concentric coiled tubing drill string and bottomhole assembly for directional and horizontal drilling.

FIG. 1*a* is a vertical cross-section of concentric coiled tubing drill string 03 and bottomhole assembly 22 useful for reverse circulation drilling of a directional or horizontal wellbore in hydrocarbon formations according to the present invention. In this embodiment, all bottomhole tools which comprise the bottomhole assembly 22 have been adapted for use with concentric coiled tubing and reverse circulation drilling. For example, an outer casing can be provided for encasing existing drilling tools for single coiled tubing, thereby providing an annulus between the outer wall of the drilling tool and the inner wall for the outer casing.

Concentric coiled tubing drill string 03 comprises an inner coiled tubing string 01 having an inside wall 70 and an outside wall 72 and an outer coiled tubing string 02 having an inside wall 74 and an outside wall 76. The inner coiled tubing string 01 is inserted inside the outer coiled tubing string 02. The outer coiled tubing string 02 typically has an outer diameter of 73.0 mm or 88.9 mm, and the inner coiled tubing string 01 typically has an outer diameter of 38.1 mm, 44.5 mm, or 50.8 mm. Other diameters of either string may be run as deemed necessary for the operation. Concentric coiled tubing drill string annulus 30 is formed between the outside wall 72 of the inner coiled tubing string 01 and the inside wall 74 of the outer coiled tubing string 02.

Concentric coiled tubing drill string 03 is connected to bottom hole assembly 22, said bottom hole assembly 22 comprising a reverse-circulating directional drilling means 04. Bottomhole assembly 22 further comprises concentric coiled tubing connector 06 and, in preferred embodiments, further comprises a downhole blowout preventor or flow control means 07, orientation means 60, disconnecting means 08, and downhole data collection and transmission means 62. Reverse-circulating directional drilling means 04 comprises bent sub or bent housing 64, rotating sub 09, reverse drculating impact hammer 80, and impact or drilling bit 78.

Bent sub or bent housing 64 provides a degree of misalignment of the directional drilling assembly 04 from the previously drilled hole. The bent sub or bent housing 64 is fixed in the string relative to a known reference angle in the downhole data collection and transmission means 62 such that the downhole data collection and transmission means is capable of communicating the orientation of the bent sub to a surface data control system through electric wireline 66. Orientation means 60 is used to provide a degree of rotation of the bent sub 64 to control the angle of misalignment of the bent sub 64. Orientation means 60 is operated by electrical communication with a surface control means through electric wireline 66.

Rotating sub 09 rotates reverse circulating impact hammer 80 and drilling bit 78 to ensure it doesn't strike at only one spot in the wellbore. Disconnecting means 08 provides a means for disconnecting concentric coiled tubing drill string 03 from the reverse-circulation drilling means 04 should it get stuck in the wellbore. Downhole flow control means 07 enables flow from the wellbore to be shut off through either or both of the inner coiled tubing string 01 and the concentric coiled tubing drill string annulus 30 between the inner coiled tubing string 01 and the outer coiled tubing string 02. Concentric coiled tubing connector 06 connects outer coiled tubing string 02 and inner coiled tubing string 01 to the bottom hole assembly 22.

Flow control means 07 operates by means of two small diameter capillary tubes 10 that are run inside inner coiled tubing string 01 and connect to closing device 07. Hydraulic or pneumatic pressure is transmitted through capillary tubes 10 from surface. Capillary tubes 10 are typically stainless steel of 6.4 mm diameter, but may be of varying material and of smaller or larger diameter as required.

Drilling medium 28 is pumped through concentric coiled tubing drill string annulus 30, through the bottomhole assembly 22, and into a flow path 36 in the revs circulating drilling means 04, while maintaining isolation from the inside of the inner coiled tubing string 01. The drilling fluid 28 powers the reverse-circulating drilling means 04, which drills a hole in the casing 32, cement 33, and/or hydrocarbon formation 34 resulting in a plurality of drill cuttings 38.

Exhaust drilling medium 35 from the reverse-circulating drilling means 04 is, in whole or in part, drawn back up inside the reverse-circulating drilling assembly 04 through a flow path 37 which is isolated from the drilling fluid 28 and the flow path 36. Along with exhaust drilling medium 35, drill cuttings 38 and formation fluids 39 are also, in whole or in part, drawn back up inside the reverse-circulating drilling assembly 04 and into flow path 37. Venturi 82 aids in accelerating exhaust drilling medium 35 to ensure that drill cuttings are removed from downhole. Shroud 84 is located between impact hammer 80 and inner wall 86 of wellbore 32 in relatively air fight and frictional engagement with the inner wall 86. Shroud 84 reduces exhaust drilling medium 35 and drill cuttings 38 from escaping up the wellbore annulus 88 between the outside wall 76 of outer coiled tubing string 02 and the inside wall 86 of wellbore 32 so that the exhaust drilling medium, drill cuttings 38, and formation fluids 39 preferentially flow up the inner coiled tubing string 01. Exhaust drilling medium 35, drill cuttings 38, and formation fluids 39 from flow path 37 are pushed to surface under formation pressure.

Figure 1B:
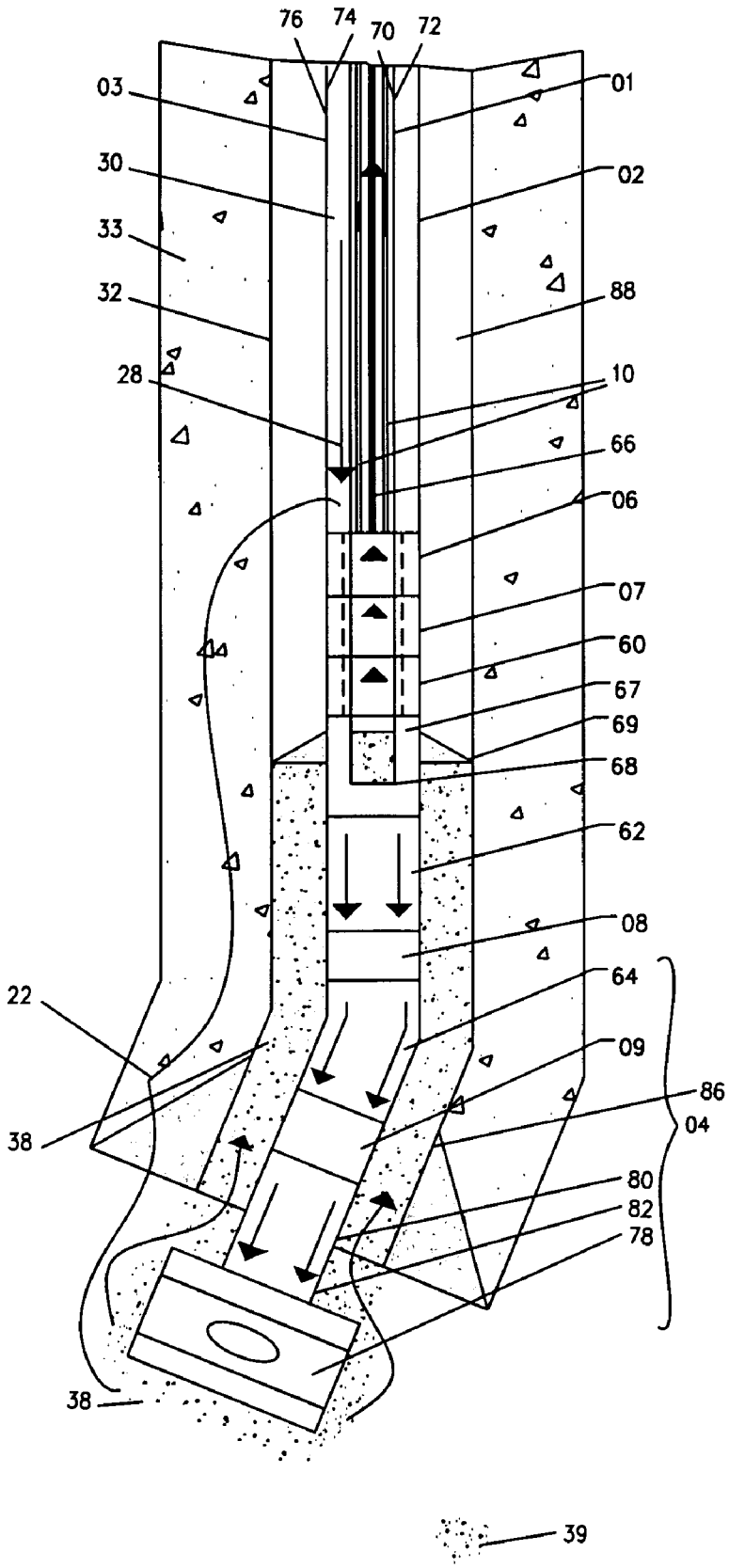
FIG. 1*b* is a vertical cross-section of a section of concentric coiled tubing drill string and bottomhole assembly having an interchange means for directional and horizontal drilling.

In another embodiment of the present invention, drilling medium can be pumped down inner coiled tubing string 01 and exhaust drilling medium carried to the surface of the wellbore through concentric coiled tubing drill string annulus 30. Reverse circulation of the present invention can use as a drilling medium air, drilling muds or drilling fluids or a combination of drilling fluid and gases such as nitrogen and air FIG. 1*b* shows another preferred embodiment which uses conventional drilling tools used with single coiled tubing. In this embodiment, bottomhole assembly 22 comprises an interchange means 67 for diverting drill cuttings 38 from the wellbore annulus 88 into the inner coiled tubing string 01. Interchange means 67 comprises vertical slot 68 to let drill cuttings 38 escape through the center of inner coiled tubing string 01. Interchange means 67 further comprises wings or shroud 69 which prevents drill cuttings 38 from continuing up the wellbore annulus to the surface of the wellbore. Generally, if the wellbore being drilled is 6¼ inches in diameter, the outer diameter (OD) of the interchange means 67 would be 5½ inches, which would include the wings or shroud 69.

Figure 2:
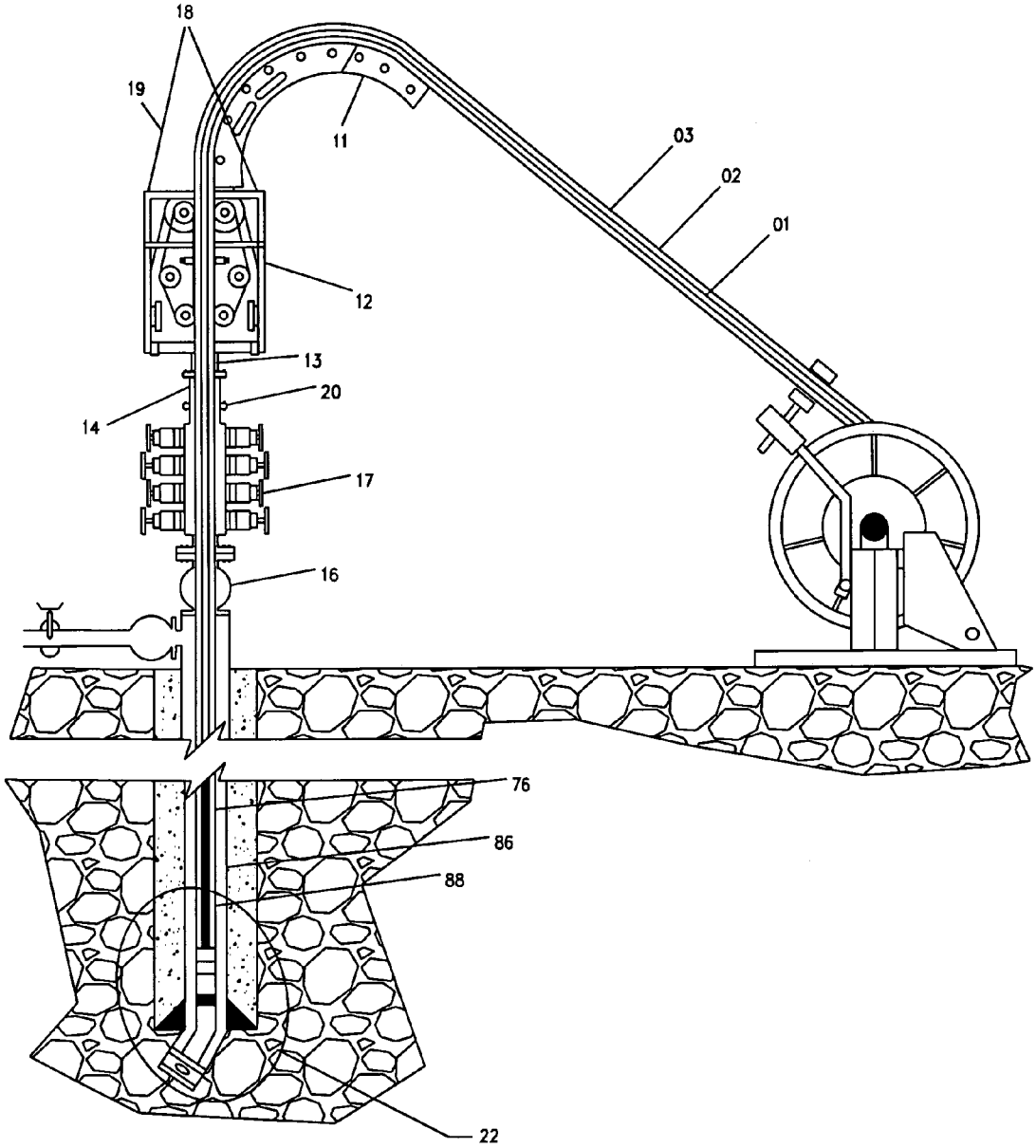
FIG. 2 is a general view showing a partial cross-section of the apparatus and method of the present invention as it is located in a drilling operation.

FIG. 2 shows a preferred embodiment of the present method and apparatus for safely drilling a natural gas well or any well containing hydrocarbons horizontally or directionally using concentric coiled tubing drilling. Concentric coiled tubing drill string 03 is run over a gooseneck or arch device 11 and stabbed into and through an injector device 12. Arch device 11 serves to bend concentric coiled tubing string 03 into injector device 12, which serves to push the concentric coiled tubing drill string into the wellbore, or pull the concentric coiled tubing string 03 from the wellbore as necessary to conduct the operation. Concentric coiled tubing drill string 03 is pushed or pulled through a stuffing box assembly 13 and into a lubricator assembly 14. Stuffing box assembly 13 serves to contain wellbore pressure and fluids, and lubricator assembly 14 allows for a length of coiled tubing or bottomhole assembly 22 to be lifted above the wellbore and allowing the wellbore to be dosed off from pressure.

As was also shown in FIG. 1, bottom hole assembly 22 is connected to the concentric coiled tubing drill string 03. Typical steps would be for the bottomhole assembly 22 to be connected to the concentric coiled tubing drill string 03 and pulled up into the lubricator assembly 14. The bottomhole assembly comprises a bent sub or housing and the angle of the bent sub or housing relative to the reference angle of measurement within the downhole data collection and transmission means is determined, and provides a corrected reference measurement for all subsequent downhole measurements of the orientation of the bent sub or housing. Lubricator assembly 14 is manipulated in an upright position directly above the wellhead 16 and surface blowout preventor 17 by means of crane 18 with a cable and hook assembly 19. Lubricator assembly 14 is attached to surface blowout preventor 17 by a quick-connect union 20. Lubricator assembly 14, stuffing box assembly 13, and surface blowout preventor 17 are pressure tested to ensure they are all capable of containing expected wellbore pressures without leaks. Downhole flow control means 07 is also tested to ensure it is capable of dosing frorn surface actuated controls (not shown) and containing wellbore pressure without leaks.

Figure 3:
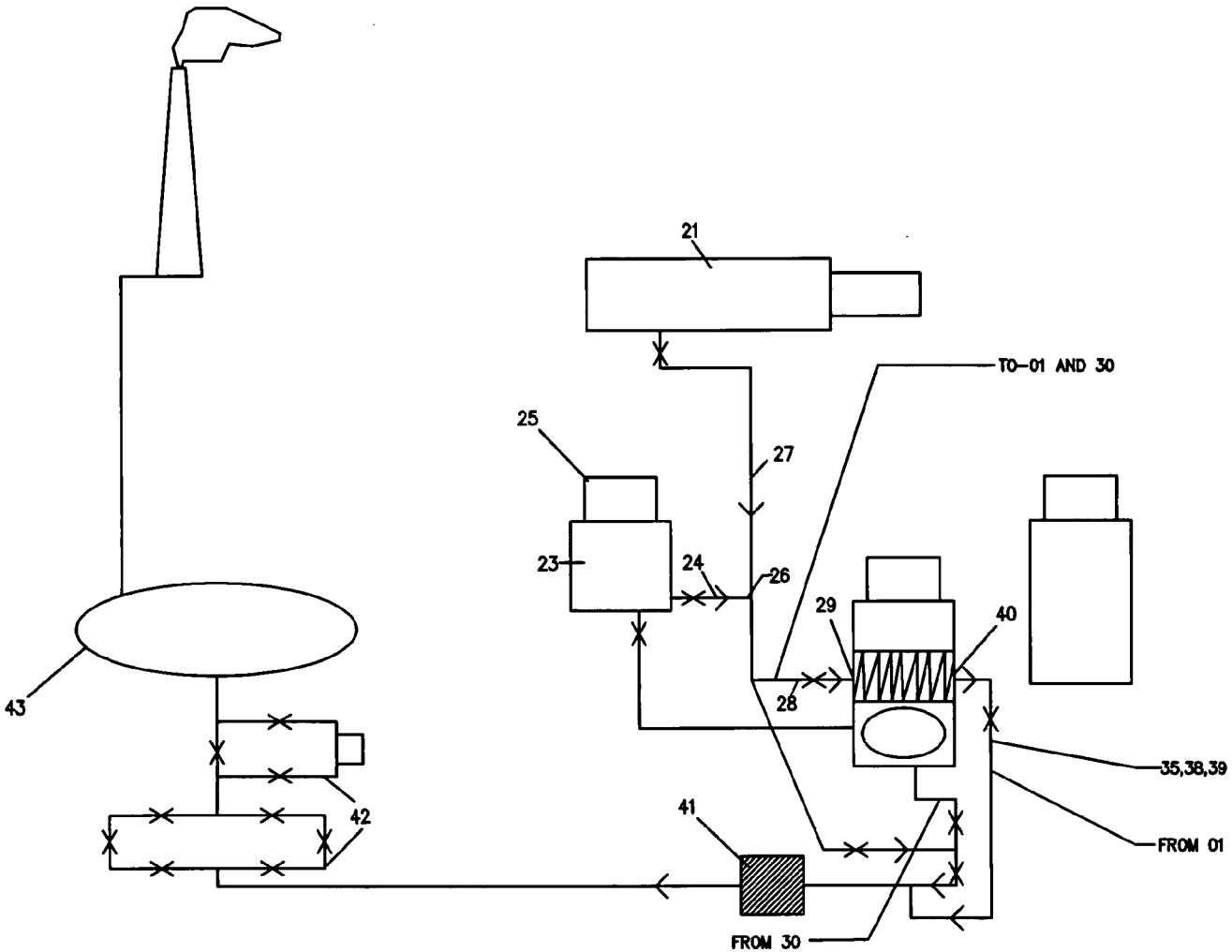
FIG. 3 is a schematic drawing of the operations used for the removal of exhaust drilling medium out of the wellbore.

Surface blowout preventor 17 is used to prevent a sudden or uncontrolled flow of hydrocarbons from escaping from the wellbore annulus 88 between the inner wellbore wall 86 and the outside wall 76 of the outer coiled tubing string 02 during the drilling operation. An example of such a blowout preventor is Texas Oil Tools Model # EG72-T004. Surface blowout preventor 17 is not equipped to control hydrocarbons flowing up the inside of concentric coiled tubing drill string, however, FIG. 3 is a schematic drawing of the operations used for the removal of exhaust drilling medium out of the wellbore. Suction compressor 41 or similar device may be placed downstream of the outlet rotating joint 40 to maintain sufficient fluid velocity inside the inner coiled tubing string 01 to keep all solids moving upwards and flowed through an outlet rotating joint 40. This is especially important when there is insufficient formation pressure to move exhaust medium 35, drill cuttings 38, and formation fluids 39 up the inner space of the inner coiled tubing string 01. Outlet rotating joint 40 allows exhaust medium 35, drill cuttings 38, and formation fluids 39 to be discharged from the inner space of inner coiled tubing string 01 while maintaining pressure control from the inner space, without leaks to atmosphere or to concentric coiled tubing drill string annulus 30 while moving the concentric coiled tubing drill string 03 into or out of the wellbore.

Upon completion of pressure testing, wellhead 16 is opened and concentric coiled tubing drill string 03 and bottom hole assembly 22 are pushed into the wellbore by the injector device 12. A hydraulic pump 23 may pump drilling mud or drilling fluid 24 from a storage tank 25 into a flow line T-junction 26. In the alternative, or in combination, air compressor or nitrogen source 21 may also pump air or nitrogen 27 into a flow line to Tlunction 26. Therefore, drilling medium 28 can consist of drilling mud or drilling fluid 24, gas 27, or a commingled stream of drilling fluid 24 and gas 27 as required for the operation.

Drilling medium 28 is pumped into the inlet rotating joint 29 which directs drilling medium 28 into concentric coiled tubing drill string annulus 30 between inner coiled tubing string 01 and outer coiled tubing sting 02. Inlet rotating joint 29 allows drilling medium 28 to be pumped into concentric coiled tubing drill string annulus 30 while maintaining pressure control from concentric coiled tubing drill string annulus 30, without leaks to atmosphere or to inner coiled tubing string 01, while moving concentric coiled tubing drill string 03 into or out of the weilbore.

Exhaust drilling medium 35, drill cuttings 38, and formation fluids 39 flow from the outlet rotating joint 40 through a plurality of piping and valves 42 to a surface separation system 43. Surface separation system 43 may comprise a length of straight piping terminating at an open tank or earthen pit, or may comprise a pressure vessel capable of separating and measuring liquid, gas, and solids. Exhaust medium 35, drill cuttings 38, and formation fluids 39, including hydrocarbons, that are not drawn into the reverse-circulation drilling assembly may flow up the wellbore annulus 88 between the outside wall 76 of outer coiled tubing string 02 and the inside wall 86 of wellbore 32. Materials flowing up the welibore annulus 88 will flow through wellhead 16 and surface blowout preventor 17 and be directed from the blowout preventor 17 to surface separation system 43.

Figure 4A:
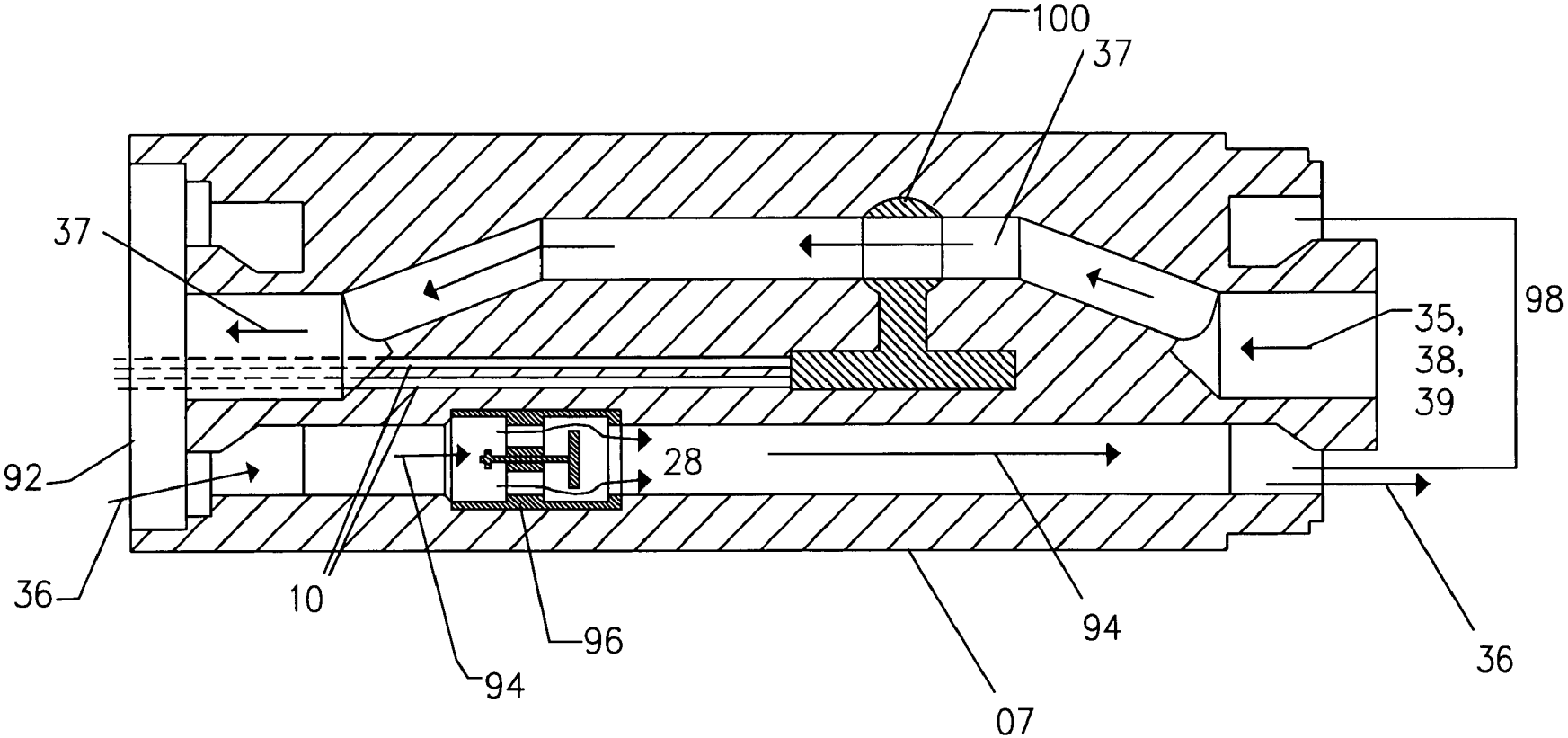
FIG. 4*a* shows a vertical cross-section of a downhole flow control means in the open position.
Figure 4B:
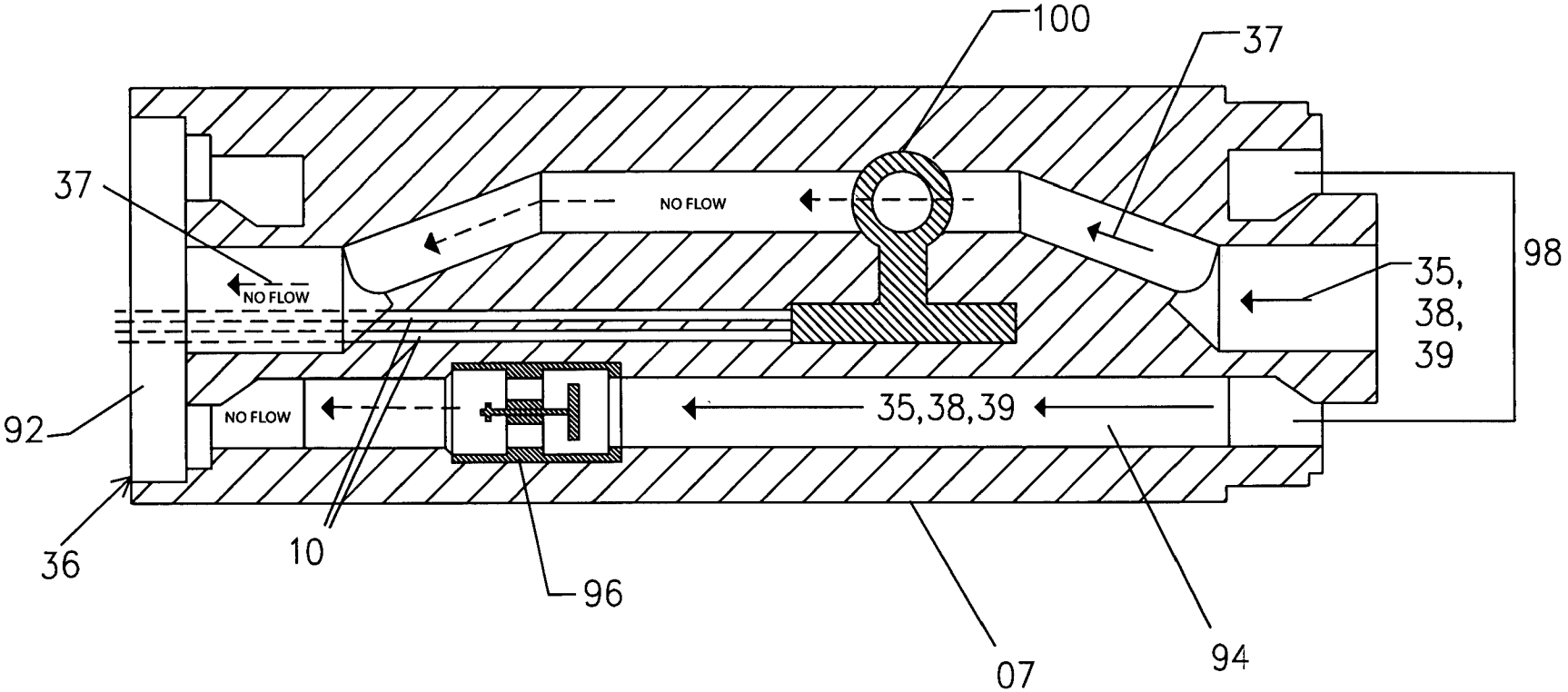
FIG. 4*b* shows a vertical cross-section of a downhole flow control means in the closed position.

FIG. 4*a* is a vertical cross-section of downhole flow control means 07 in open position and FIG. 4*b* is a vertical cross-section of downhole flow control means 07 in dosed position. Downhole flow control means 07 may be required within motor head assembly 05 to enable flow from the wellbore to be shut off through either or both of the inner coiled tubing string 01 or the concentric coiled tubing drill string annulus 30. For effective well control, the closing device should be capable of being operated from surface by a means independent of the wellbore conditions, or in response to an overpressure situation from the wellbore.

Referring first to FIG. 4*a*, the downhole flow control means 07 allows drilling medium 28 to flow through annular flow path 36. Drilling medium from the annular flow path 36 is directed in first diffuser sub 92 that takes the annular flow path 36 and channels it into single monobore flow path 94. Drilling medium 28 flows through single monobore flow path 94 and through a check valve means 96 which allows flow in the intended direction, but operates under a spring mechanism to stop flow from reversing direction and traveling back up the annular flow path 36 or the single monobore flow path 94. Downstream of check valve means 96 single monobor flow path 94 is directed through second diffuser sub 98 which redirects flow from single monobore flow path 94 back to annular flow path 36. When operated in th open position, exhaust drilling medium 35, drill cuttings 38 and formation fluid 39, including hydrocarbons, flow up through inner coiled tubing flow path 37. Inner coiled tubing flow path 37 passes through hydraulically operated ball valve 100 that allows full, unobstructed flow when operated in the open position.

Referring now to FIG. 4*b*, downhole flow control means 07 is shown in the closed position. To provide well control from inner coiled tubing flow path 37, hydraulic pressure is applied at pump 47 to one of capillary tubes 10. This causes ball valve 100 to close thereby dosing off inner coiled tubing flow path 37 and preventing uncontrolled flow of formation fluids or gas through the inner coiled tubing string 01. In the event of an overpressure situation in single monobore flow path 94, check valve 96 closes with the reversed flow and prevents reverse flow through single monobore flow path 94. In this embodiment, wellbore flow is thus prohibited from flowing up annular flow path 36 or single monobore flow path 94 in the event formation pressure exceeds pumping pressure, thereby providing well control in the annular flow path 36.

An optional feature of downhole flow control means 07 would allow communication between single monobore flow path 94 and inner coiled tubing flow path 37 when the downhole flow control means is operated in the dosed position. This would allow continued circulation down annular flow path 36 and back up inner coiled tubing flow path 37 without being open to the wellbore. It is understood that integral to flow control means 07 is the ability to provide passage of electrical signals from electric wireline 60 through flow control means 07 to orientation means 60 and the downhole data collection and transmission means, as shown in FIGS. 1*a* and 1*b*.

Figure 5:
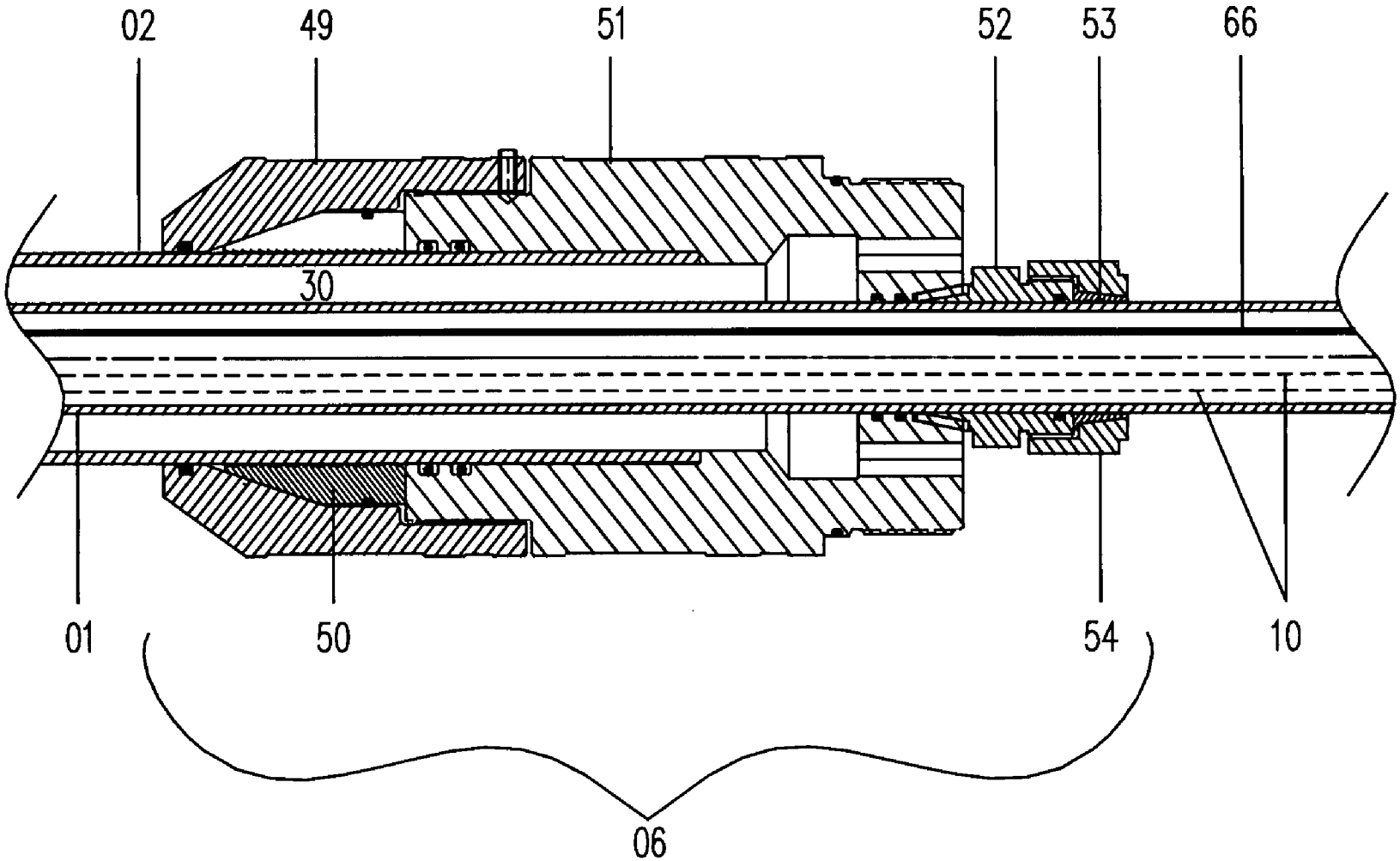
FIG. 5 shows a vertical cross-section of a concentric coiled tubing connector.

FIG. 5 is a vertical cross-section of concentric coiled tubing connector 06. Both outer coiled tubing string 02 and the inner coiled tubing string 01 are connected to bottom hole assembly by means of concentric coiled tubing connector 06. First connector cap 49 is placed over outer coiled tubing string 02. First external slip rings 50 are placed inside first connector cap 49, and are compressed onto outer coiled tubing string 02 by first connector sub 51, which is threaded into first connector cap 49. Inner coiled tubing string 01 is extended through the bottom of first connector sub 51, and second connector cap 52 is placed over inner coiled tubing string 01 and threaded into first connector sub 51. Second external slip rings 53 are placed inside second connector cap 52, and are compressed onto inner coiled tubing string 01 by second connector sub 54, which is threaded into second connector cap 52. First connector sub 51 is ported to allow flow through the sub body from concentric coiled tubing drill string annulus 30.

Figure 6:
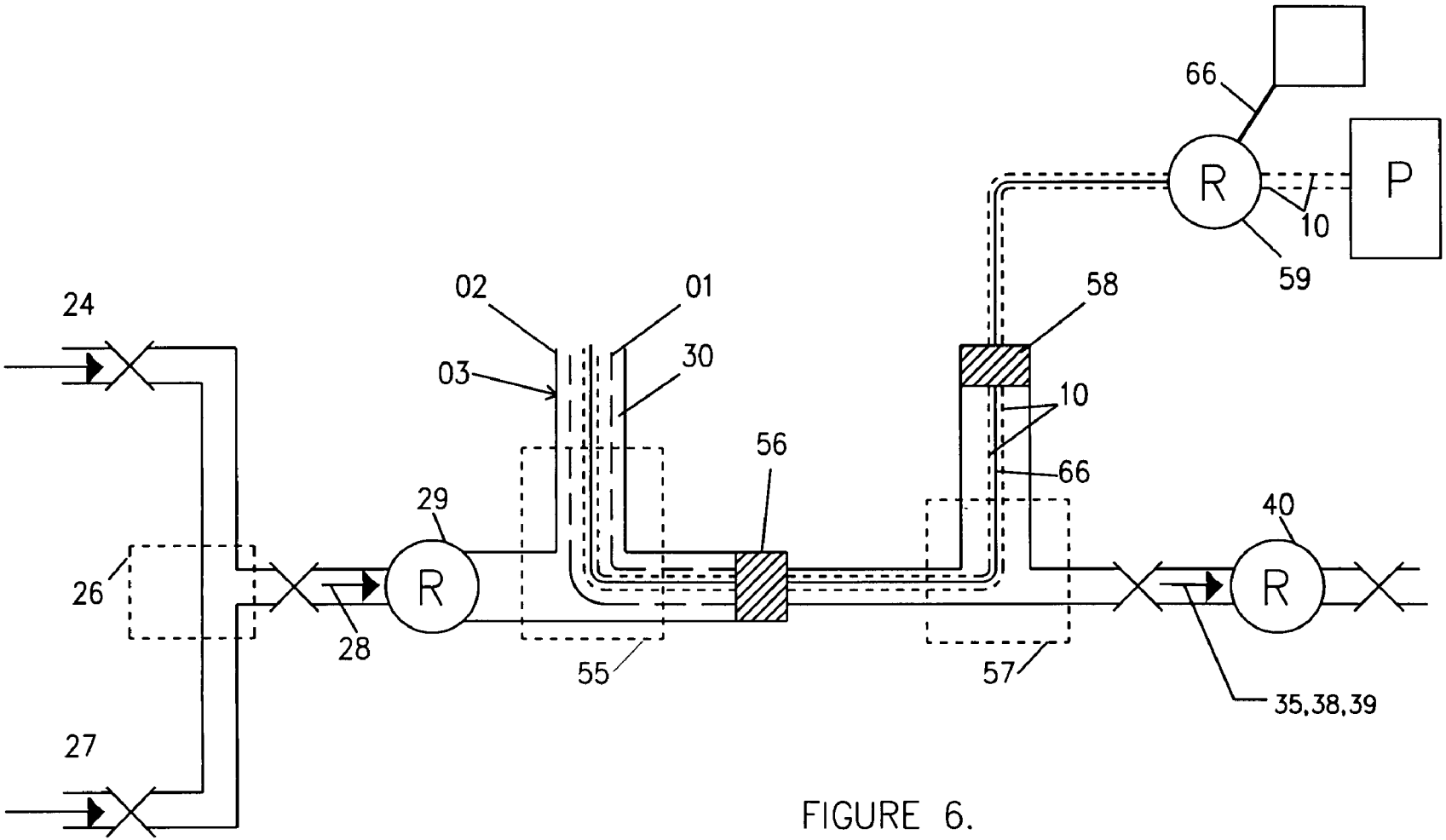
FIG. 6 is a schematic drawing of a concentric coiled tubing bulkhead assembly.

FIG. 6 is a schematic diagram of a coiled tubing bulkhead assembly. Drilling medium 28 is pumped into rotary joint 29 to first coiled tubing bulkhead 55, which is connected to the concentric coiled tubing drill string 03 by way of outer coiled tubing string 02 and ultimately feeds concentric coiled tubing drill string annulus 30. First coiled tubing bulkhead 55 is also connected to inner coiled tubing string 01 such that flow from the inner coiled tubing string 01 is isolated from concentric coiled tubing drill string annulus 30, Inner coiled tubing string 01 is run through a first packoff device 56 which removes it from contact with concentric coiled tubing drill string annulus 30 and connects it to second coiled tubing bulkhead 57. Flow from inner coiled tubing string 01 flows through second coiled tubing bulkhead 57, through a series of valves, and ultimately to outlet rotary joint 40, which permits flow from inner coiled tubing string 01 under pressure while the concentric coiled tubing drill string 03 is moved into or out of the well. Flow from inner coiled tubing string 01, which comprises exhaust drilling medium 35, drill cuttings 38 and formation fluid 39, including hydrocarbons, is therefore allowed through outlet rotary joint 40 and allowed to discharge to the surface separation system.

An additional feature of second coiled tubing bulkhead 57 is that it provides for the insertion of an electric cable and one or more smaller diameter tubes or devices, with pressure control, into the inner coiled tubing string 01 through second packoff 58. In the preferred embodiment, second packoff 58 provides for two capillary tubes 10 to be run inside the inner coiled tubing string 01 for the operation and control of downhole flow control means 07, the orientation means 60, or both, It further provides for an electric wireline 66 to be run inside the inner coiled tubing string 01 for the operation and control of the orientation means 60, the downhole data collection and transmission means 62, or both. The capillary tubes 10 and electric wireline 66 are connected to a third rotating joint 59, allowing pressure control of the capillary tubes 10 and electric wireline 66 while rotating the work reel.

While various embodiments in accordance with the present invention have been shown and described, it is understood that the same is not limited thereto, but is susceptible of numerous changes and modifications as known to those skilled in the art and therefore the present invention is not to be limited to the details shown and described herein, but intend to cover all such changes and modifications as are encompassed by the scope of the appended claims.

I claim:

1. A method of drilling a directional or horizontal wellbore in a hydrocarbon formation, comprising:

providing a concentric coiled tubing drill string having an inner coiled tubing string, said inner coiled tubing string having an inside wall and an outside wall and situated within an outer coiled tubing string having an inside wall and an outside wall, said outside wall of said inner coiled tubing string and said inside wall of said outer coiled tubing string defining an annulus between the coiled tubing strings;

connecting a bottomhole assembly comprising a directional drilling means, said directional drilling means having a drill bit and a downhole motor or an air hammer for operating the drill bit, to said coiled tubing drill string so that the bottomhole assembly is in fluid communication with the coiled tubing drill sting;

delivering drilling medium through one of said annulus or inner coiled tubing string to said downhole motor or air hammer for operating the drill bit to form said directional or horizontal wellbore; and extracting exhaust drilling medium through said other of said annulus or inner coiled tubing string.

2. The method of claim 1 wherein the drilling medium is delivered through the annulus and the exhaust driliing medium is extracted through the inner coiled tubing string.

3. The method of claim 1 wherein the drilling medium is delivered through the inner coiled tubing string and the exhaust drilling medium extracted through the annulus.

4. The method of claim 1 wherein said exhaust drilling medium comprises drilling medium and drilling cuttings.

5. The method of claim 1 wherein said exhaust drilling medium comprises drilling medium, drilling cuttings and hydrocarbons.

6. The method of claim 1 wherein said directional drilling means is a reverse circulating directional drilling means.

7. The method of claim 1 wherein said drilling medium is selected from the group comprising drilling mud, drilling fluid and a mixture of drilling fluid and gas.

8. The method of claim 7 wherein said directional drilling means further comprises a bent sub or housing.

9. The method of claim 1 wherein said downhole motor comprises a positive displacement motor.

10. The method of claim 1 wherein said downhole motor is a mud motor.

11. The method of claim 1 wherein said drilling medium comprises a gas selected from the group comprising air, nitrogen, carbon dioxide, methane or any combination of air, nitrogen, carbon dioxide or methane.

12. The method of claim 11 wherein said directional drilling means comprises a reciprocating air hammer, a drill bit and a bent sub or housing.

13. The method of claim 1 wherein said air hammer is a reverse circulating reciprocating air hammer.

14. The method of claim 1 wherein said directional drilling means comprises a positive displacement motor, a reverse circulating drill bit and a bent sub or housing.

15. The method of claim 1, said directional drilling means further comprising a diverter means, said method further comprising the step of accelerating said exhaust drilling medium by passing said exhaust drilling medium through said diverter means so as to facilitate extraction of said exhaust drilling medium through the annulus or the inner coiled tubing string.

16. The method of claim 15 wherein said diverter means comprises a venturi or a fluid pumping means.

17. The method of claim 1 further comprising the step of providing a downhole flow control means positioned at or near the directional drilling means for preventing flow of hydrocarbons from the inner coiled tubing string or the annulus or both to the surface of the wellbore.

18. The method of claim 17 further comprising the step of controlling said downhole flow control means at the surface of the wellbore by a surface control means.

19. The method of claim 18 wherein said surface control means transmits a signal selected from the group comprising an electrical signal, a hydraulic signal, a pneumatic signal, a light signal or a radio signal.

20. The method of claim 1 further comprising the step of providing a surface flow control means positioned at or near the surface of the wellbore for preventing flow of hydrocarbons from a space between the outside wall of the outer coiled tubing string and a wall of the borehole.

21. The method of claim 1, said concentric coiled tubing drill string further comprising a discharging means positioned near the top of said concentric coiled tubing drill string, said method further comprising the step of removing said exhaust drilling medium through said discharging means away from said wellbore.

22. The method of claim 21 wherein said discharging means further comprises a flare means for flaring hydrocarbons produced from the wellbore.

23. The method of claim 1 further comprising the step of providing a shroud means positioned between the outside wall of the outer coiled tubing string and a wall of the wellbore for reducing the flow of exhaust drilling medium from the directional drilling means to a space between the outside wall of the outer coiled tubing string and a wall of the borehole.

24. The method of claim 1 further comprising the step of providing a suction type compressor for extracting said exhaust drilling medium through said annulus or inner coiled tubing string.

25. The method of claim 1 further comprising the step of reducing the surface pressure in the inner coiled tubing string by means of a surface pressure reducing means attached to the inner coiled tubing string.

26. The method of claim 1 further comprising the step of providing an orientation means for rotating said directional drilling means.

27. The method of claim 1 further comprising the step of providing a downhole data collection and transmission means for giving drilling associated parameters.

28. The method of claim 27 wherein said downhole data collection and transmission means comprises a measurement-while-drilling tool or a logging-while-drilling tool or both.

29. The method of claim 1 further comprising the step of providing an interchange means for directing said exhaust drilling medium through said annulus or inner coiled tubing string.

30. An apparatus for drilling a directional or horizontal wellbore in a hydrocarbon formation, comprising:

a concentric coiled tubing drill string having an inner coiled tubing string, said inner coiled tubing string having an inside wall and an outside wall and situated within an outer coiled tubing string having an inside wall and an outside wall, said outside wall of said inner coiled tubing string and said inside wall of said outer coiled tubing string defining an annulus between the coiled tubing strings;

a bottomhole assembly comprising a directional drilling means, said directional drilling means havina a drill bit and a downhole motor or an air hammer for operating the drill bit, operably connected to said concentric coiled tubing drill string; and a drilling medium delivery means for delivering drilling medium through one of said annulus or inner coiled tubing string for operating said directional drilling means to form said directional or horizontal wellbore and for entraining and removing drill cuttings through said other of said annulus or inner coiled tubing string.

31. The apparatus of claim 30 wherein said directional drilling means is a reverse circulating directional drilling means.

32. The apparatus of claim 30 wherein said directional drilling means further comprises a bent sub or housing.

33. The apparatus of claim 30 wherein said downhole motor comprises a mud motor.

34. The apparatus of claim 33 wherein said mud motor is a reverse circulating mud motor.

35. The apparatus of claim 30 wherein said directional drilling means comprises a reciprocating air hammer, a drill bit and a bent sub or housing.

36. The apparatus of claim 30 wherein said air hammer is a reverse circulating reciprocating air hammer.

37. The apparatus of claim 30 wherein said dowahole motor comprises a positive displacement motor.

38. The apparatus of claim 30 wherein said directional drilling means further comprising a diverter means to facilitate removal of said exhaust drilling medium from the concentric coiled tubing drill string.

39. The apparatus of claim 38 wherein said diverter means comprises a venturi or a fluid pumping means.

40. The apparatus of claim 30 further comprising a downhole flow control means positioned at or near said directional drilling means for preventing flow of hydrocarbons from the inner coiled tubing string or the annulus or both to the surface of the wellbore.

41. The apparatus of claim 40 further comprising a surface control means for controlling said downhole flow control means at the surface of the wellbore.

42. The apparatus of claim 41 wherein said surface control means transmits a signal selected from the group comprising an electrical signal, a hydraulic signal, a pneumatic signal, a light signal or a radio signal.

43. The apparatus of claim 30 further comprising a surface flow control means positioned at or near the surface of the weilbore for reducing flow of hydrocarbons from a space between the outside wall of the outer coiled tubing string and a wall of the borehole.

44. The apparatus of claim 30 wherein said concentric coiled tubing drill string further comprises a discharging means positioned near the top of said concentric coiled tubing drill string for discharging said exhaust drilling medium through said discharging means away from said wellbore.

45. The apparatus of claim 44 wherein said discharging means further comprises a flare means for flaring hydrocarbons produced from the wellbore.

46. The apparatus of claim 30 further comprising a shroud means positioned between the outside wall of the outer coiled tubing string and a wall of the weilbore for reducing the flow of exhaust drilling medium from the directional drilling means to a space between the outside wall of the outer coiled tubing string and a wall of the borehole.

47. The apparatus of claim 30 further comprising a suction type compressor for extracting said exhaust drilling medium through said annulus or inner coiled tubing string.

48. The apparatus of claim 30 further comprising a connecting means for connecting said outer coiled tubing string and said inner coiled tubing string to said directional drilling means thereby centering said inner coiled tubing string within said outer coiled tubing string.

49. The apparatus of claim 48 further comprising a disconnecting means located between said connecting means and said directional drilling means for disconnecting said directional drilling means from said concentric coiled tubing drill string.

50. The apparatus of claim 30, said directional drilling means having the air hammer and further comprising a rotation means attached to said air hammer.

51. The apparatus of claim 30 further comprising means for storing said concentric coiled tubing drill string.

52. The apparatus of claim 51 wherein said storing means comprises a work reel.

53. The apparatus of claim 30 wherein said exhaust drilling medium comprises drilling medium and drilling cuttings.

54. The apparatus of claim 30 wherein said exhaust drilling medium comprises drilling medium, drilling cuttings and hydrocarbons.

55. The apparatus of claim 30 further comprising an orientation means for rotating said directional drilling means.

56. The apparatus of claim 30 further comprising a downhole data collection and transmission means for conferring drilling associated parameters.

57. The apparatus of claim 56 wherein said downhole data collection and transmission means comprises a measurement-while-drilling tool or a logging-while-drilling tool or both.

58. The apparatus of claim 30 wherein said bottomhole assembly further comprises one or more tools selected from the group consisting of a downhole data collection and transmission means, a shock sub, a drill collar and an interchange means for directing said exhaust drilling medium through said annulus or inner coiled tubing string.

59. The method of claim 1, said bottomhole assembly having a top end and a bottom end, wherein said bottomhole assembly further comprises an interchange means located at or near the top end.

60. The apparatus of claim 30, said bottomhole assembly having a top end and a bottom end, wherein said bottomhole assembly further comprises an interchange means located at or near the top end.

* * * * *